US006042407A

United States Patent [19]

Scull et al.

[11] Patent Number: 6,042,407

[45] Date of Patent: Mar. 28, 2000

[54] SAFE-OPERATING LOAD REDUCING TAP PLUG AND METHOD USING THE SAME

[75] Inventors: Douglas W. Scull, Johnson City, Tenn.; Robert T. Tintle, Stewartsville, N.J.

[73] Assignee: Hubbell Incorporated, Orange, Conn.

[21] Appl. No.: 09/065,222

[22] Filed: Apr. 23, 1998

[51] Int. Cl.[7] ..... H01R 13/53

[52] U.S. Cl. ..... 439/181

[58] Field of Search ..... 439/181–187, 439/507, 784, 805, 921

[56] References Cited

U.S. PATENT DOCUMENTS

| | | | |
|---|---|---|---|
| 4,787,855 | 11/1988 | Finke | 439/92 |
| 4,857,021 | 8/1989 | Boliver et al. | 439/801 |
| 4,865,559 | 9/1989 | Clabburn | 439/281 |
| 4,891,016 | 1/1990 | Luzzi et al. | 439/183 |
| 4,955,823 | 9/1990 | Luzzi | 439/507 |
| 5,427,538 | 6/1995 | Knapp et al. | 439/157 |

OTHER PUBLICATIONS

Amerace Corporation, Stick–Operable 600–Amp Connector Systems, Elastimold (Feb. 1984), pp. 1–10.

Amerace Corporation, Installation Instructions 650LRTPA3 Elbow Tap Plug, Elastimold (Jun., 1986), pp. 1–4.

Cooper Power Systems, 600 A 15 kV Class Push–Op Deadbreak Connector, Molded Rubber Products (Jan. 1990), pp. 1–2.

Cooper Power Systems, 600 A 15 kV Class T–OP–II Deadbreak Connector, Molded Rubber Products (Jan. 1990), pp. 1–2.

Cooper Power Systems, 600 A 35 kV Class T–Op Connector Assembly Installation Instructions, Deadbreak Apparatus Connectors (May, 1992), pp. 1–6.

Thomas & Betts, Separable Connectors Cam–Op, Link–Op 600 Series Deadbreak, Elastimold (Feb., 1997), p. 14.

*Primary Examiner*—Khiem Nguyen

*Attorney, Agent, or Firm*—Jerry M. Presson; Alfred N. Goodman; Mark S. Bicks

[57] ABSTRACT

A safe operating load reducing tap plug for testing, grounding and isolating a connector from a high voltage system by utilizing a rated bushing insert is disclosed, wherein the connector has a bushing port and a plug port connected to a high-voltage cable, and wherein the bushing port is mountable to electric equipment. The plug includes a deadbreak interface having an interface contact assembly receivable in the bushing port, the interface contact assembly being connectable to the high-voltage cable and the equipment; a loadbreak interface having an aperture extending through to the deadbreak interface; and a bushing well interface having a well for receiving the rated bushing insert, the bushing well having a bar stud extending therefrom which is electrically connectable to the interface contact assembly. The connector is tested through the rated bushing insert to initially confirm that the high voltage cable is de-energized. Next, the connector is grounded through the rated bushing insert, and finally, the connector is isolated by disconnecting the interface contact assembly from the equipment.

19 Claims, 4 Drawing Sheets

SAFE-OPERATING LOAD REDUCING TAP PLUG AND METHOD USING THE SAME

TECHNICAL FIELD

The present invention herein resides generally in the art of high voltage power connectors. More particularly, the present invention relates to a safe-operating load reducing tap plug and method for using the same. Specifically, the present invention relates to a load reducing tap plug which allows for grounding a high voltage cable and attached connector while detaching the connector from an electrical equipment bushing.

BACKGROUND ART

In underground high-voltage power distribution systems it will be appreciated that safety is always a primary concern. Whenever possible, line crews servicing components of the underground power distribution system must see a visible break between the high voltage cables and the electrical equipment prior to working on components of the system. To ensure their safety, line crews use insulated "hot sticks" to maintain a safe distance from the equipment as connections and disconnections are made between the high voltage cables and the equipment. If a visible break is not made between the cable and the equipment while working on the system, the line crew undertakes a very serious risk that the cable can be accidently re-energized and cause injury. As will be understood by the skilled artisan, the term "equipment" as used herein may be a transformer, switch, or junction product installed in a padmount enclosure or other high voltage environment.

An example of a known operating system used to connect and disconnect high voltage cables to and from equipment is schematically shown in FIGS. 1A–D and described below. As seen in FIG. 1A, a known operating system is generally designated by the numeral 10, and includes an equipment cabinet panel 12 upon which is mounted an appropriately rated equipment bushing 14. A 600 amp elbow connector, which is generally indicated by the numeral 16, is connected to the bushing 14 and includes a terminated high voltage cable 18. An appropriately rated load reducing tap plug 20 is installed in the other side of the elbow 16 while an insulating cap 24 is provided over the opposite end of the plug 20. FIG. 1A shows the operating system 10 in a normal energized condition.

Whenever work is required to be performed on the electrical equipment or any circuit or component connected downstream of the equipment, the operator(s) open a switch (not shown) that de-energizes the cable 18. Next, as seen in FIG. 1B, the operator removes the insulating cap 24 and inserts a test rod 26 into the load reducing tap plug 20 to confirm that the cable 18 is no longer energized. As seen in FIG. 1C, the operator next installs a grounding elbow or similar device 28 on to the load reducing tap plug 20. Should the cable 18 accidently become re-energized, the grounding elbow 28 shunts the current to ground and prevents excessive voltage from appearing on the cable 18 and possibly injuring the operator.

As stated previously, most operators are required to directly see that the portion of the underground power system that they are working on is clearly disconnected from the equipment. This also permits testing of the portion of the circuit being worked upon prior to re-energizing the circuit. In order to accomplish the physically visible break in the connection, reference is made to FIG. 1D. In particular, the grounding elbow 28 is removed from the plug 20 and one operator inserts a tool 30 held by a "hot stick" or insulated operating implement 32 into the plug 20. Simultaneously, a second operator uses another implement 32 to hold the elbow connector 16. The first operator rotates the tool 30 to disconnect an internally threaded connection in the elbow connector 16 from the equipment bushing 14. It will be appreciated that the second operator is required to hold the base of the elbow connector 16 to provide additional support as the first operator rotates the tool 30. Once the operator completes disconnection of the elbow 16 from the equipment bushing 14, the elbow 16 is placed upon a parking station available on the cabinet panel 12.

From the above description of the known operating system 10, it is apparent that there is no grounding of the cable 18 during use of the tool 30. Therefore, the operator(s) are placed at great risk in the event the cable 18 is accidently re-energized during this time.

In light of the foregoing, it is evident that there is a need in the art for a safe-operating load reducing tap plug which ensures continual grounding of the elbow connector during its disconnection from the equipment bushing. Moreover, there is a desire in the art for a disconnection process which only requires the use of one person in a line crew.

DISCLOSURE OF INVENTION

In light of the foregoing, it is a first aspect of the present invention to provide a safe-operating load reducing tap plug.

Another aspect of the present invention is to provide a safe-operating load reducing tap plug for testing, grounding and isolating a connector from a high voltage system by utilizing a rated bushing insert, wherein the connector has a bushing port and a plug port, and a terminated high voltage cable, the bushing port being mountable to an equipment bushing.

Yet another aspect of the present invention, as set forth above, is to provide the safe-operating load reducing tap plug with a deadbreak interface opposite a loadbreak interface and a radially extending bushing well interface wherein an aperture is provided through the deadbreak interface and the loadbreak interface.

Still another aspect of the present invention, as set forth above, is to provide the loadbreak interface with either a loadbreak assembly as provided in known load reducing tap plugs, or a dummy insert.

A further aspect of the present invention, as set forth above, is to provide the deadbreak interface with a conductive sleeve which is connectable to the loadbreak assembly and wherein an interface contact assembly is rotatably received within the conductive sleeve.

Still a further aspect of the present invention, as set forth above, is to provide the interface contact assembly with a contact barrel connected to a stud barrel by shear pins, wherein the contact barrel is connectable to the high voltage cable and wherein the stud barrel is connectable to a bushing stud extending from the equipment bushing.

An additional aspect of the present invention, as set forth above, is to provide the bushing well interface with a bar stud that is connected to a bus bar that radially extends from the conductive sleeve, and wherein the bushing well interface receives the rated bushing insert.

Yet an additional aspect of the present invention, as set forth above, is to provide for the connection, energization, and safe disconnection of the connector from the equipment by testing the connector through the rated bushing insert to initially confirm that the high voltage cable is de-energized, by providing a ground to the connector through the rated bushing insert and wherein the connector is isolated by disconnecting the interface contact assembly from the equipment bushing.

The foregoing and other aspects of the present invention, which shall become apparent as the detailed description proceeds, are achieved by a safe operating load reducing tap plug for testing, grounding and isolating a connector from a high voltage system by utilizing a rated bushing insert, wherein the connector has a bushing port and a plug port, and a terminated high-voltage cable, and wherein the bushing port is mountable to electrical equipment, comprising a deadbreak interface having an interface contact assembly receivable in the bushing port, the interface contact assembly connectable to the high-voltage cable and the equipment, a loadbreak interface having an aperture extending through to the deadbreak interface, and a bushing well interface having a well for receiving the rated bushing insert, the bushing well having a bar stud extending therefrom which is electrically connected to the interface contact assembly, wherein the connector is tested through the rated bushing insert to initially confirm that the high voltage cable is de-energized, wherein the connector is grounded through the rated bushing insert, and wherein the connector is isolated by disconnecting the interface contact assembly from the electrical equipment.

Other aspects of the present invention are obtained by a safe operating load reducing tap plug receivable by a connector mounted to an equipment bushing from which extends a stud, comprising means for allowing detachment of the connector, and means for testing and grounding the connector connected to the means for allowing, wherein the means for testing and grounding permits the connector to be safely detached from the equipment bushing.

Still other aspects of the present invention are obtained by a method for securing a safe operating load reducing tap plug to a de-energized elbow connector having a bushing port opposite a plug port, wherein the bushing port is connectable to a bushing having a stud that is connected to electrical equipment, wherein a cable is receivable between the bushing port and the plug port, and wherein the safe operating load reducing tap plug facilitates the testing, grounding and isolating of the elbow connector and cable when energized, comprising the steps of providing a safe operating load reducing tap plug having a loadbreak interface opposite a deadbreak interface with an aperture therethrough, and a bushing well interface, the aperture having a conductive sleeve with an interface contact assembly therein, the bushing well interface having a threaded stud connected to the conductive sleeve, securing the interface contact assembly to the de-energized elbow connector and to the stud, whereupon the elbow connector and cable are energized, de-energizing the cable, testing the elbow connector by probing the bushing well interface with a test rod to confirm that the cable is in fact de-energized, grounding the elbow connector and cable by coupling the bushing well interface to ground, and isolating the elbow connector by disconnecting the interface contact assembly from the stud.

BRIEF DESCRIPTION OF THE DRAWINGS

For a complete understanding of the objects, techniques and structure of the invention, reference should be made to the following detailed description and accompanying drawings wherein.

BEST MODE FOR CARRYING OUT THE INVENTION

Figure 1A:
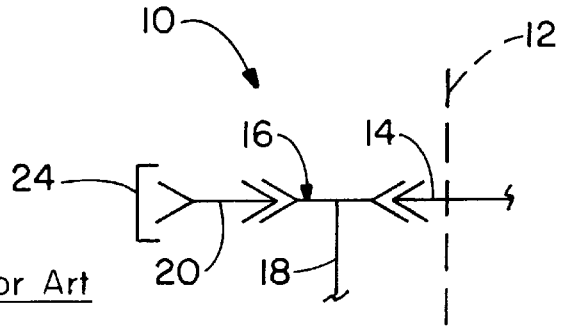
FIG.-1A Prior Art
FIGS. 1A–D are schematic illustrations of the known method of disconnecting a connector from an equipment bushing.
Figure 1B:
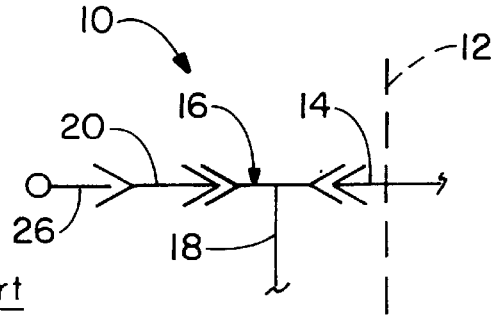
FIG.-1B Prior Art
Figure 1C:
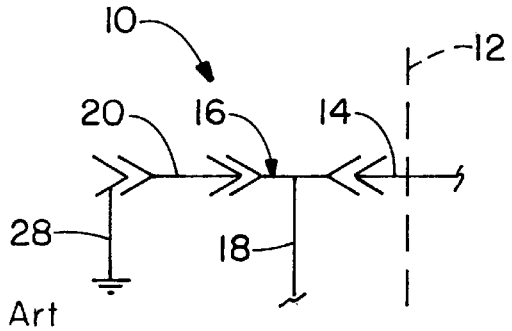
FIG.-1C Prior Art
Figure 1D:
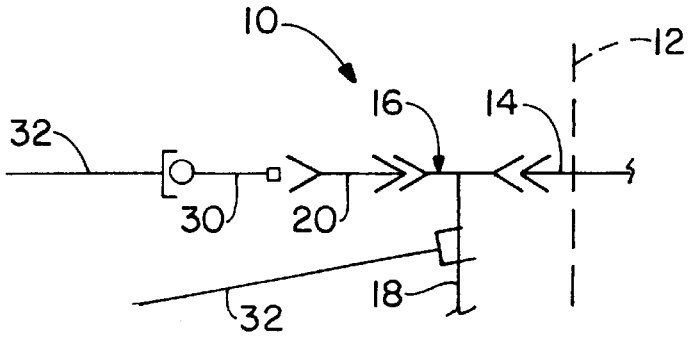
FIG.-1D Prior Art
Figure 2:
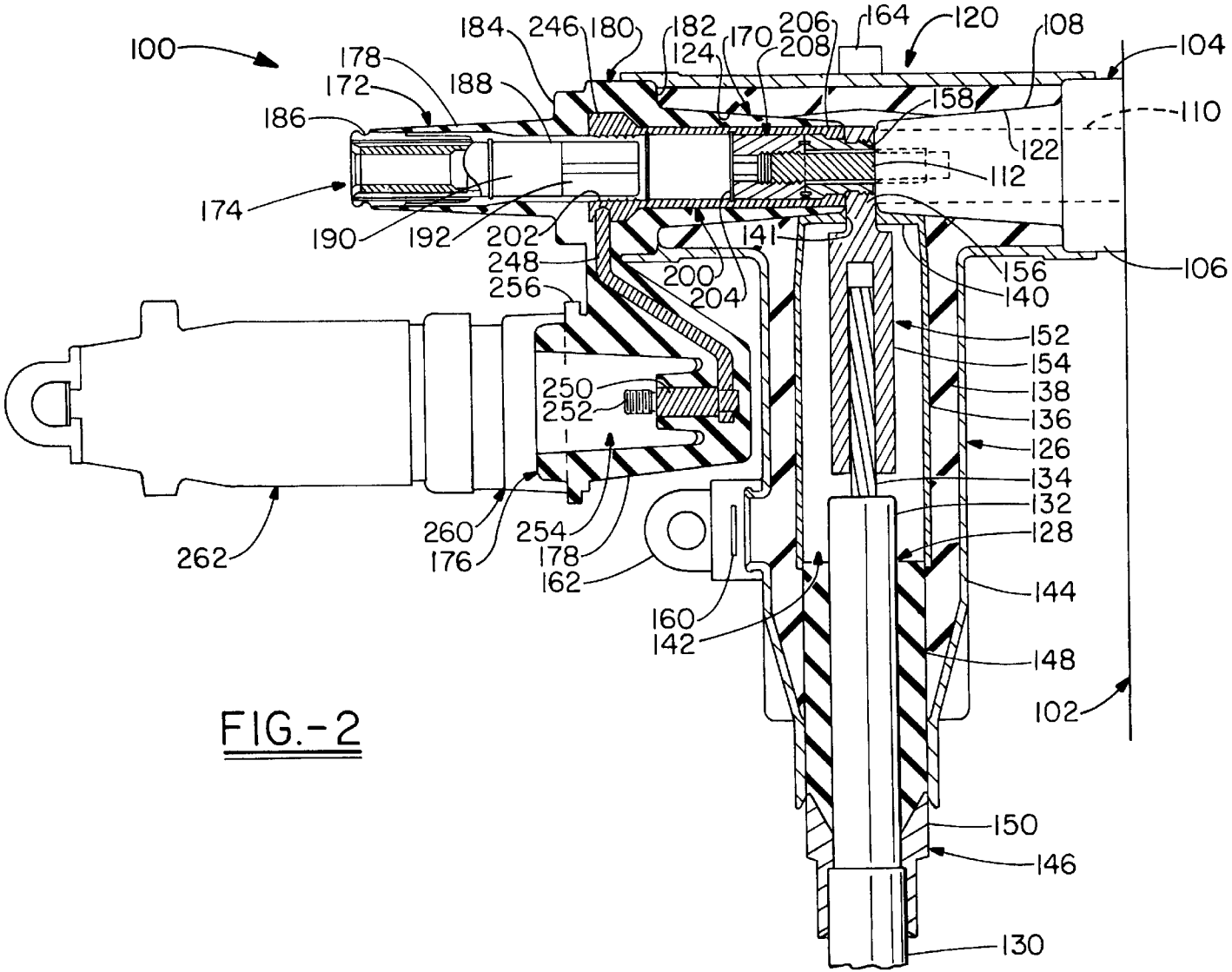
FIG. 2 is a cross-sectional view of a safe-operating load reducing tap plug connected to an elbow connector and electrical equipment.
Figure 3:
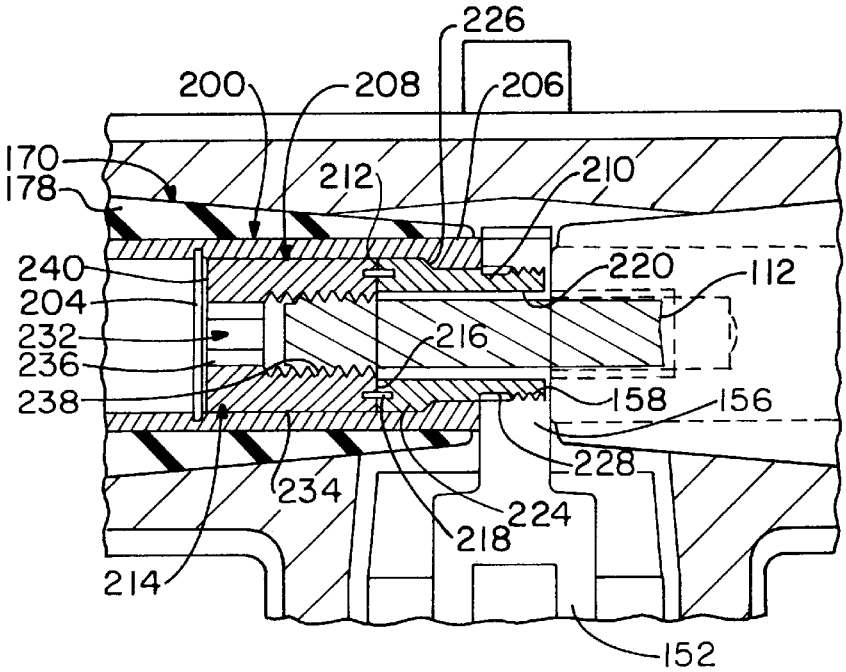
FIG. 3 is an enlarged cross-sectional view of the interface contact assembly employed in the safe-operating load reducing tap plug.
Figure 4:
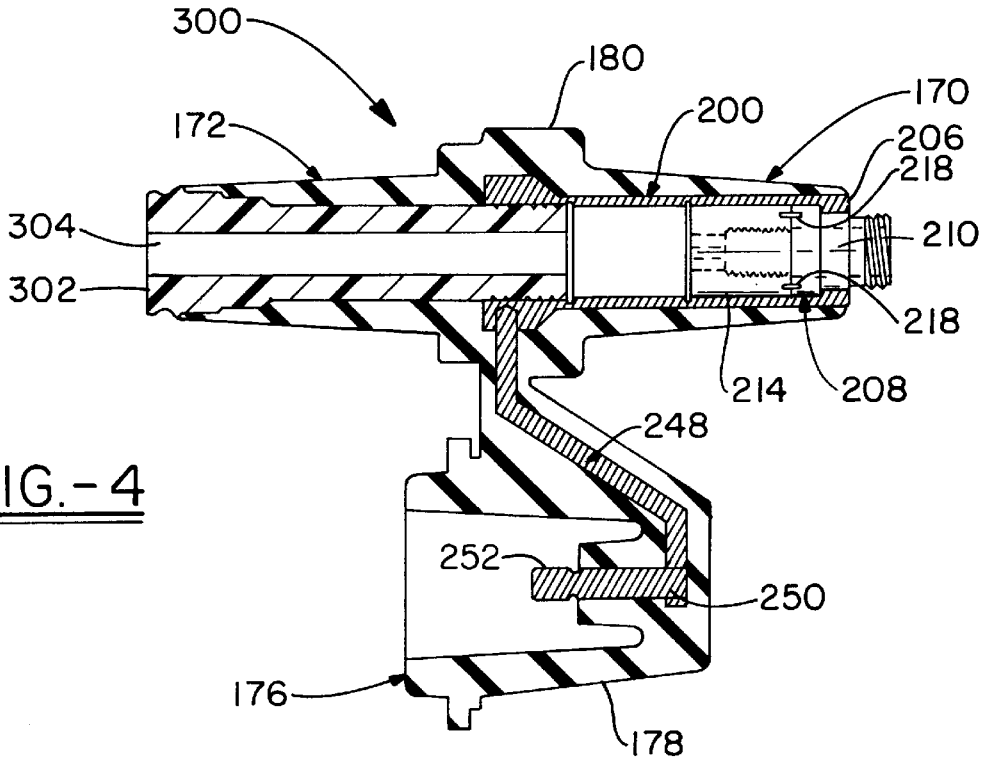
FIG. 4 is a cross-sectional view of a safe-operating load reducing tap plug with a dummy insert.

Referring now to the drawings, and more particularly to FIGS. 2–4, it can be seen that a safe-operating load reducing tap plug is designated generally by the numeral 100. As shown, the plug 100 is used in underground power distribution systems which may include equipment received in above-ground utility enclosures. Generally, the underground distribution systems are energized by a sub-station which receives electrical power from a power generation facility. From the sub-station, high-voltage cables are routed underground to the utility enclosures which contain equipment for switching circuits and also stepping down the power for delivery to businesses and homes. The above-ground utility enclosure provides a panel 102 wherein only the grounded front side of the panel is shown. Those skilled in the art will appreciate that the livefront (not shown) of the panel 102 provides the equipment and necessary connections to the service destination. Mounted to the panel 102 is a 600 amp bushing 104 which is typically made of an insulating epoxy material. The bushing 104 includes a base 106 with an outwardly extending frusto-conical portion 108. A conductive bus 110 extends through the bushing 104 from the end of the frusto-conical portion 108 to the equipment (not shown). An externally threaded bushing stud 112 integrally extends from the conductive bus 110 away from the frusto-conical portion 108.

A 600 amp elbow connector, which is generally indicated by the numeral 120, is slidably mounted upon the bushing 104. The connector 120 includes a bushing port 122 which is diametrically opposite a plug port 124. The elbow connector 120 is T-shaped with the bushing port 122 and plug port 124 forming the horizontal portion of the T and a cable entry leg 126 extending downwardly from a midpoint between the bushing port 122 and the plug port 124 forming the vertical portion of the T.

A high voltage cable 128 is received in the cable entry leg 126. As those skilled in the art will appreciate, the high voltage cable 128 includes a semi-conductive jacket 130 which is disposed over a dielectric material 132. A conductor 134, which may be either copper, aluminum, or an alloy thereof, is surrounded by the dielectric material 132. A semi-conductive screen (not shown) is provided between the conductor 134 and the dielectric material 132.

A conductive cup 136 is provided inside the cable entry leg 126 and receives a prepared end of the cable 128. The cup 136 is surrounded by a molded insulation material 138, which in the preferred embodiment is a peroxide cured EPDM, that is distributed throughout the interior of the elbow connector 120. The cup 136 provides a partially closed end 140, which has a contact hole 141, opposite an open end 142 which receives the prepared end of the cable 128. A molded semi-conductive shield material 144, which in the preferred embodiment is a peroxide cured EPDM, is chemically bonded to and disposed around the insulation material 138.

A cable adapter insert 146 is interposed between the high voltage cable 128 and the cable entry leg 126. The cable adapter insert 146 provides an insulation section 148, the inner diameter of which contacts the dielectric 132 and the outer diameter of which contacts the shield material 144, the insulation material 138, and the cup 136; and a conductive outer section 150 which contacts the jacket 130, the dielectric 132, and the shield material 144. It will be appreciated that the cable adapter insert 146 is appropriately sized to accommodate various diameters of cable while providing contact to the appropriate portions of the cable adapter entry leg 126. The cable insert 146 provides electrical and physical stress relief between the cable 128 and the connector 120.

A conductor contact 152, which is preferably made of a copper or aluminum material, is received in the cup 136. The conductor contact 152 includes a crimp barrel 154 for attachment to the exposed conductor 134 by crimping as is well known in the art. Extending from the crimp barrel 154 is a spade contact 156 which includes an internally threaded opening 158. The spade contact 156 extends through the contact hole 141 provided by the cup 136.

Additional features of the elbow connector 120 are a capacitive test point 160, which is covered by an eyelet cap 162, and a rib 164 which provides for static grounding of the horizontal portion of the elbow connector 120.

The plug 100 is slidably received in the plug port 124 much like any known load reducing tap plug. The plug 100 is shown as a 15 kV interface that conforms to IEEE Standard 386. It will also be appreciated that the plug 100 could also be provided in a 25 kV or 35 kV configuration. The plug 100 includes a deadbreak interface 170 opposite a loadbreak interface 172. Extending through the deadbreak interface 170 and the loadbreak interface 172 is an aperture 174. Integrally extending radially from the deadbreak interface 170 and the loadbreak interface 172 is a bushing well interface 176. An insulative material 178, which in the preferred embodiment is an epoxy material, surrounds the internal components of the deadbreak interface 170, the loadbreak interface 172 and the bushing well interface 176. Of course, the insulative material 178 could be any moldable resin or polymeric material that provides the desired electrical properties.

A collar 180 interconnects the three interfaces 170, 172 and 176, and provides an elbow edge 182 and an edge 184. The elbow edge 182 abuts an inner surface of the elbow connector 120. The edge 184 provides a bearing surface for when an insulating cap or loadbreak elbow is installed over the loadbreak interface 172. A locking groove 186 is provided at the end of the loadbreak interface 172 which conforms with IEEE Standard 386.

A loadbreak assembly 188 is received within the loadbreak interface 172. The loadbreak assembly 188 includes a contact 190 which is capable of receiving a mating contact from an appropriately rated elbow connector. Connected to the contact 190 is a piston assembly 192 which assists the operator under fault closed conditions to complete the connection to the appropriately rated connector when required.

A conductive sleeve 200 extends from the loadbreak assembly 188 into the deadbreak interface 170. The conductive sleeve 200 includes internal threads 202 for connection to the piston assembly 192. An internally disposed piston stop ring 204 is provided by the conductive sleeve 200 at about a mid-point thereof. An inwardly extending lip 206 is provided at an end of the conductive sleeve 200 opposite the stop ring 204.

As best seen in FIG. 3, an interface contact assembly 208 is rotatably received between the stop ring 204 and the lip 206. The interface contact assembly 208 is made of a conductive material and includes a contact barrel 210, which is connectable to the contact 152, and a bearing face 212. The interface contact assembly 208 also includes a stud barrel 214, which is connectable to the threaded bushing stud 112, and a bearing face 216 which contacts the face 212. At least one axially directed shear pin 218 connects the faces 212 and 216 to one another. Although the shear pins 218 are shown axially disposed, it will be appreciated that they could be radially disposed between the contact barrel 210 and the stud barrel 214 with modifications to the faces 212 and 216.

The contact barrel 210 provides a through hole 220 which receives the bushing stud 112. The contact barrel 210 further includes a head 224 that is slidable within the conductive sleeve 200 and a shoulder 226 which slidably bears against the inwardly extending lip 206. An externally threaded shaft 228 extends from the shoulder 226 and is threadably receivable in the internally threaded opening 158.

The stud barrel 214 provides a through hole 232 which is concentrically aligned with the through hole 220. The stud barrel 214 includes an outer surface 234 that is rotatable within the conductive sleeve 200. The stud barrel 214 provides a hex-shape insert 236 at an end opposite the face 216. The insert 236 may be any other shape or configuration which allows for receiving a tool, through the aperture 176, for the purpose of rotating the interface contact assembly 208 when attaching the plug 100 to the cable 130 and the bushing 104. The stud barrel 214 includes a threaded inner collar 238 which is attachable to the threaded bushing stud 112 when the insert 236 is rotated. The stud barrel 214 also provides an end face 240 which slidably bears against the stop ring 204.

Interconnecting the conductive sleeve 200 to the bushing well interface 176 is a radially extending rib 246. Radially extending from the rib 246 is a bus bar 248 which may be angularly directed toward the cable entry leg 126. This is done so that the bushing well interface is in a somewhat recessed position with respect to the loadbreak interface 172. It will be appreciated that space within the equipment cabinet is at a minimum and anything to provide additional space is appreciated by the operating personnel. The bushing well interface 176 includes a bar stud 250 which provides a threaded end 252 that extends outwardly into a well 254 of the bushing well interface 176. The opposite end of the bar stud 250 is connected to the bus bar 248. The bushing well interface 176 may also include a stop edge 256.

The plug 100 is connected to the de-energized cable 130 and the bushing 104 in the following manner. Initially, the cable adapter insert 146 is placed over the cable 128, which is then prepared and connected to the conductor contact 152 in a manner well known in the art. Next, the spade contact 156 is inserted into the cup 136 and through the contact hole 141. The deadbreak interface 170 is then inserted into the plug port 124. At this time, an operator inserts a driving tool into the insert 236 and rotates the interface contact assembly 208. Accordingly, the shaft 228 engages and connects to the internally threaded opening 158. This threading process continues until the contact barrel 210 fully engages the spade contact 156 at which time the interface contact assembly 208 stops rotating. At this time, the operator applies additional torque to the interface contact assembly 208 and breaks the shear pins 218.

The plug 100 and the connector 120 are then mountable upon the equipment bushing 104. It will be appreciated then that the bushing stud 112 is received in the through hole 220 and the through hole 232. The operator then rotates the stud barrel 214 via the insert 236 with the appropriate torquing tool such that the inner collar 238 engages and connects to the threaded stud bushing 112. When the stud barrel 214 stops rotating after applying a recommended torque with an appropriate torquing tool, the operator withdraws the tool. An insulating cap, such as the one schematically identified as numeral 24, is disposed on the loadbreak interface 172. A rated bushing insert 260 is then threadably connected to the bar stud 250. The rated bushing insert 260 may be provided in a 15 kV, 25 kV, or 35 kV configuration. The bushing insert 260 is then capable of receiving an appropriately rated elbow connector, grounding elbow or an insulating cap 262 which covers and prevents exposure to the bushing well interface 176. The insulating cap 262 is equivalent to the cap 24 discussed in conjunction with FIG. 1. Afterwards, the cable 128 and the connector 120 may be energized from the sub-station to power the equipment associated with the panel 102.

Referring now to FIG. 4, it will be appreciated that an alternative safe-operating load reducing tap plug, which is generally designated by the numeral 300 may be provided. The plug 300 is exactly the same as the plug 100 except that a dummy insert 302 replaces the loadbreak assembly previously discussed. The dummy insert 302 may be made of a polymeric, plastic, epoxy or even metallic material, with the only limitation being that the material is structurally rigid enough to withstand molding pressures created if the plug 300 is made of a molding material. The dummy insert 302 provides a through hole 304 which allows for insertion of tools as previously discussed. The benefit of this variation is that the cost of including the loadbreak assembly is eliminated. All other exterior and interior structural elements of the plug 300 are equivalent to the elements of the plug 100.

Figure 5A:
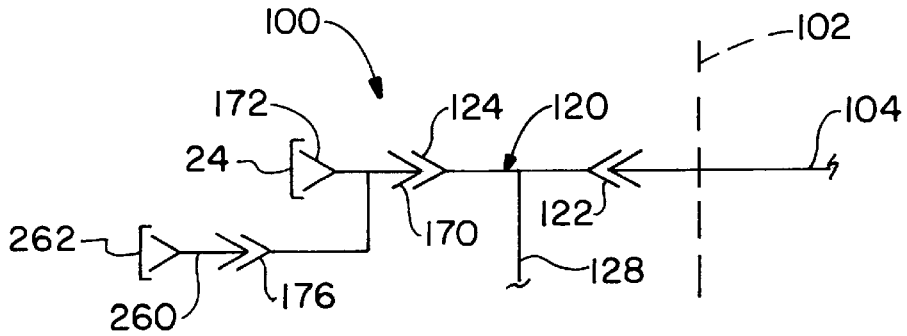
FIGS. 5A–D are schematic illustrations of the safe-operating load reducing tap plug used in a new method of disconnecting the connector from the transformer bushing.

Referring now to FIGS. 5A–D, a schematic version of the operating plug 100 in use is presented. In particular, FIG. 5A shows that the connector 120 is mounted upon the bushing 104 and is also connected to the plug 100. One end of the rated bushing insert 260 is inserted into the bushing well interface 176 and the other end is provided with the insulating cap 262. A second insulating cap 24 or 262 is provided on the loadbreak interface 172. In normal operating conditions, the cable 128 is energized and the equipment powers the connections thereto. When servicing is required upon the service installations or to the equipment, the operator de-energizes the cable 128 at a point which is typically remote from the operating plug 100.

Figure 5B:
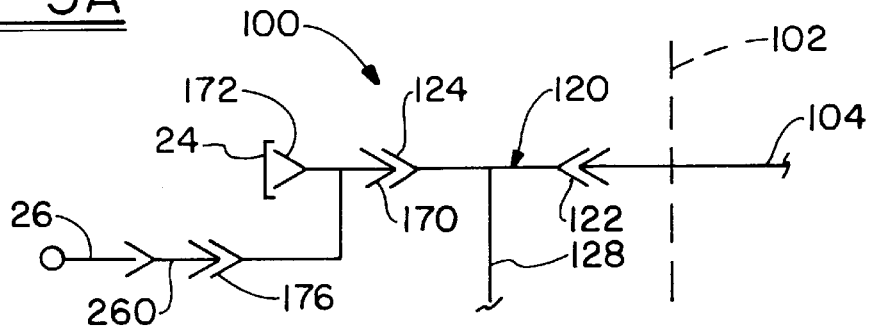

Referring now to FIG. 5B, the operator removes the insulating cap 262 and inserts a test rod 26 into the rated bushing insert 260 to test and confirm that the cable 128 has in fact been de-energized. In other words, the test rod 26 probes the bushing well interface 176, and in particular the voltage value of the threaded end 252, through the rated bushing insert 260.

Figure 5C:
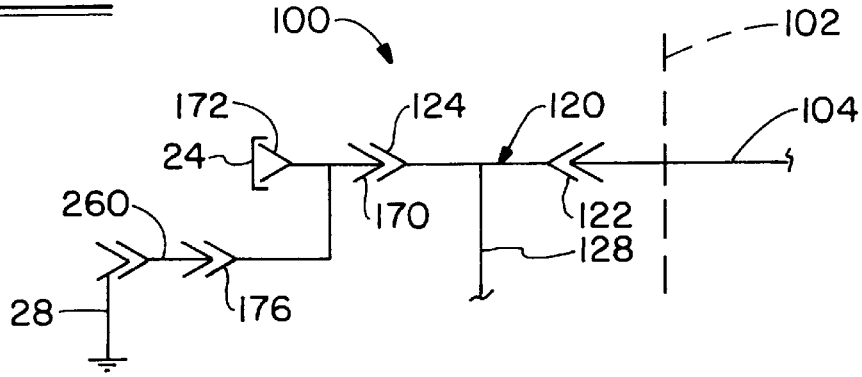

Referring now to FIG. 5C, the operator installs a grounding elbow or similar device 28 onto the rating bushing insert 260, thus providing a continual ground path for the safety of the operator. By coupling the grounding elbow 28 to the bushing well interface 176, through the bushing insert 260, it will be appreciated that any accidental re-energization of the cable 128 is shunted to ground.

Figure 5D:
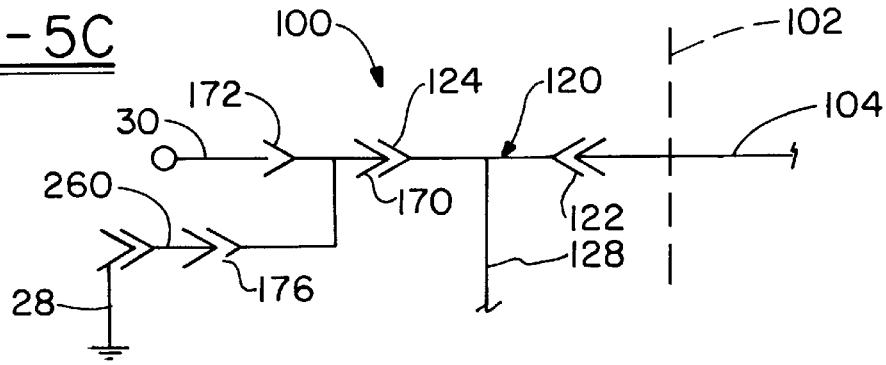

Referring now to FIG. 5D, the operator removes the second insulating cap 24 and inserts an appropriate tool 30, using an insulated operating implement, into the plug 100 and in particular, through the aperture 174 so as to contact the interface contact assembly 208. Thus, it will be appreciated that if the cable 128 is accidently re-energized as the operator is utilizing the tool 30 to disconnect the connector 120 from the bushing 104, the voltage is directed through the bushing well interface 176, the rated bushing insert 260, the grounding elbow 28 and then to ground. Clearly, this significantly reduces any dangerous exposure to the operator as the connector 120 is disconnected from the bushing 104.

As the operator rotates the tool 30, the stud barrel 214 disengages from the bushing stud 112. Upon release thereof, the operator removes the tool 30 and may then employ the insulated implement to remove and isolate the connector 120 from the bushing 104. At this time, the connector 120 may be placed upon a parking station provided on the equipment cabinet. When work is completed on the cable 128 or equipment, the connector 120 may be re-attached to the bushing port 104 by performing the above steps in reverse order.

Based upon the structure and method of use of the plug 100 or 300, it will be appreciated that the present invention is advantageous for several reasons. First, the primary advantage of the present invention is that once a ground is applied to the safe-operating plug 100, it is never removed during the disassembly process of connector 120 from the equipment bushing 104. Still a further advantage of the present invention is that it has been found easier to assemble to connectors 120 and bushings 104 as opposed to currently known systems. Still another advantage is that only one person may be required to perform the assembly and disassembly operations. Yet another advantage is that a rated bushing insert 260 can be replaced in the event during the grounding process the cable accidently becomes energized. The position of safe-operating load reducing tap plug 100 may be selected by operator before tightening connection. This allows the operator to work around other installed cables and the like. Another advantage is that the safe-operating plug 100 may be retrofitted in existing installations.

Thus, it can be seen that the objects of the invention have been satisfied by the structure and use of the invention as presented above. While only the best mode of preferred embodiment of the invention has been presented and described in detail, it is to be understood that the invention is not limited thereto or thereby. Accordingly, for an appreciation of the true scope and breadth of the invention, reference should be made to the following claims.

What is claimed is:

1. A safe operating load reducing tap plug for testing, grounding and isolating a connector from a high voltage system by utilizing a rated bushing insert, wherein the connector has a bushing port and a plug port, and a terminated high-voltage cable, and wherein the bushing port is mountable to electrical equipment, comprising:

a deadbreak interface having an interface contact assembly receivable in the plug port, said interface contact assembly being connectable to the high-voltage cable and the equipment;

a loadbreak interface having an aperture extending through to said deadbreak interface; and a bushing well interface having a well for receiving the rated bushing insert, said bushing well having a bar stud extending therefrom which is electrically connected to said interface contact assembly;

whereby the connector is tested through the rated bushing insert to initially confirm that the high voltage cable is de-energized, the connector is grounded through the rated bushing insert, and the connector is isolated by disconnecting said interface contact assembly from the electrical equipment.

2. The safe operating load reducing tap plug according to claim 1, further comprising:

a conductive sleeve received in said aperture, said conductive sleeve having a stop ring opposed by a lip at an end of said conductive sleeve, wherein said interface contact assembly is rotatably received between said stop ring and said lip.

3. The safe operating load reducing tap plug according to claim 2, wherein said interface contact assembly comprises:

a contact barrel connectable to the high voltage cable, said contact barrel having a shoulder that slidably bears against said lip, and said contact barrel having a contact barrel through hole;

a stud barrel having an insert and a through hole aligned with said contact barrel through hole; and at least one shear pin interconnecting said contact barrel to said stud barrel wherein said interface contact assembly is rotated to connect said contact barrel to the high voltage cable and upon said shear pin breaking said stud barrel connects to a bushing stud extending from the equipment.

4. The safe operating load reducing tap plug according to claim 3, wherein said loadbreak interface comprises:

a contact for receiving a mating contact; and a piston assembly connected to said contact, wherein said contact and said piston assembly are connected to said conductive sleeve.

5. The safe operating load reducing tap plug according to claim 4, further comprising:

a bus bar radially extending from said conductive sleeve, said bar stud axially extending from said bus bar at an end opposite said conductive sleeve into a well provided by said bushing well interface.

6. The safe operating load reducing tap plug according to claim 3, wherein said loadbreak interface comprises:

a dummy insert having a through hole therethrough axially aligned with said conductive sleeve.

7. A safe operating load reducing tap plug receivable by a connector mounted to an equipment bushing from which extends a stud, comprising:

means for allowing detachment of the connector, said means for allowing detachment including a deadbreak interface mateable with the connector and a loadbreak interface extending from said deadbreak interface;

an interface contact assembly rotatable received in said deadbreak interface, said interface contact assembly having a contact barrel connectable with the connector and a stud barrel connectable with the stud of said equipment bushing, said contact barrel being connected to said stud barrel by at least one shear pin, upon connection of said contact barrel to the connector said shear pin being broken allowing said stud barrel to be connected with the stud of said equipment bushing; and, means for testing and grounding the connector to said means for allowing detachment, wherein said means for testing and grounding permits the connector to be safely detached from the equipment bushing.

8. The safe operating load reducing tap plug according to claim 7, further comprising:

a conductive sleeve slidably receiving said interface contact assembly; and a bus bar extending from said conductive sleeve to said means for grounding.

9. A method for securing a safe operating load reducing tap plug to a de-energized elbow connector having a bushing port opposite a plug port, wherein said bushing port is connectable to a bushing having a stud that is connected to electrical equipment, wherein a cable is receivable between the bushing port and the plug port, and wherein the safe operating load reducing tap plug facilitates the testing, grounding and isolating of the elbow connector and cable when energized, comprising the steps of:

providing a safe operating load reducing tap plug having a loadbreak interface opposite a deadbreak interface with an aperture therethrough, and a bushing well interface, said aperture having a conductive sleeve with an interface contact assembly therein, said bushing well interface having a threaded stud connected to said conductive sleeve;

securing said interface contact assembly to the de-energized elbow connector and to the stud, whereupon the elbow connector and cable are energized;

de-energizing the cable;

testing the elbow connector by probing said bushing well interface with a test rod to confirm that the cable is in fact de-energized;

grounding the elbow connector and cable by coupling said bushing well interface to ground; and isolating the elbow connector by disconnecting said interface contact assembly from the stud.

10. The method according to claim 9, further comprising the step of:

providing said conductive sleeve with a stop ring and a lip for slidably retaining said interface contact assembly.

11. The method according to claim 9, further comprising the step of:

providing said interface contact assembly with a contact barrel having a through hole and a stud barrel having internal threads, said contact barrel connected to said stud barrel by at least one shear pin.

12. The method according to claim 1, wherein the electrical cable provides a conductor contact and wherein said step of securing further comprises the steps of:

rotating said interface contact assembly to fully engage said contact barrel with the conductor contact;

breaking said at least one shear pin; and rotating said stud barrel to engage the stud.

13. The method according to claim 9, further comprising the step of:

providing a bus bar radially extending from said conductive sleeve to said bar stud.

14. The method according to claim 9, further comprising the step of:

providing a loadbreak assembly in said loadbreak interface that is electrically connected to said conductive sleeve.

15. The method according to claim 9, further comprising the step of:

providing a dummy insert in said loadbreak interface that is coupled to said conductive sleeve.

16. The method according to claim 9, further comprising the step of:

attaching a rated bushing insert to said bushing well interface.

17. A safe operating load reducing tap plug for testing, grounding and disconnecting a connector from an electrical equipment bushing insert, the connector having a bushing port and an opposing plug port, comprising:

a deadbreak interface mateable to the plug port of the connector to connect said deadbreak interface to a high voltage cable;

a loadbreak interface extending from said deadbreak interface;

a bushing well interface directly connected to said deadbreak interface for receiving a rated bushing insert;

whereby the bushing port of the connector is mateable to the equipment bushing insert, and the connector may be disconnected from the equipment bushing insert while remaining grounded through the rated bushing insert.

18. The safe operating load reducing tap plug according to claim 17, further comprising:

an interface contact assembly rotatably received in said deadbreak interface, said interface contact assembly having a contact barrel connectable with the connector and a stud barrel connectable with a stud of said equipment bushing insert.

19. The safe operating load reducing tap plug according to claim 17 further comprising:

said bushing well interface having a bar stud extending therefrom; and a bus bar extending from said bar stud, said bus bar connectable to said connector through said deadbreak interface.

* * * * *